US007113198B2

(12) United States Patent
MacKay et al.

(10) Patent No.: US 7,113,198 B2
(45) Date of Patent: Sep. 26, 2006

(54) METHOD AND SYSTEM FOR CREATION OF SECURE DOCUMENTS USING DIGITAL EMBOSSING OF THERMAL MEDIA WITH THERMAL PRINT HEADS

(75) Inventors: Donald G. MacKay, Roxbury, CT (US); Benjamin Singer, Bridgeport, CT (US); Frederick W. Ryan, Jr., Oxford, CT (US)

(73) Assignee: Pitney Bowes Inc., Stamford, CT (US)

( * ) Notice: Subject to any disclaimer, the term of this patent is extended or adjusted under 35 U.S.C. 154(b) by 170 days.

(21) Appl. No.: 10/936,251

(22) Filed: Sep. 8, 2004

(65) Prior Publication Data

US 2006/0050136 A1 Mar. 9, 2006

(51) Int. Cl.
*B41J 2/32* (2006.01)

(52) U.S. Cl. ..... 347/171

(58) Field of Classification Search ..... 347/171; 400/120.01

See application file for complete search history.

(56) References Cited

U.S. PATENT DOCUMENTS 5,369,419 A * 11/1994 Stephenson et al. ..... 347/61
5,732,979 A * 3/1998 Finke et al. ..... 283/81
2004/0165052 A1* 8/2004 Fukui ..... 347/171

* cited by examiner

*Primary Examiner*—Huan Tran
(74) *Attorney, Agent, or Firm*—Ronald Reichman; Angelo N. Chaclas

(57) ABSTRACT

A method and system for thermal printing of secure documents. A contact thermal printing system includes: a) thermal print head having at least one heater element; and b) a thermal printer controller. The printer controller is programmed to: 1) move the print head in a predetermined pattern while the print head is in contact with a top coating of a thermal print medium; 2) overdrive the heater element during predetermined parts of the pattern to a temperature sufficient to soften or melt the top coating, thereby forming a pattern of striations in the top coating; and 3) control the heater element to print at least part of an image on the medium. The contact surface of the print head can have a specific pattern of features for forming the striations, whereby a pattern of striations formed can encode information both in the direction of the motion of the print head and transversely to the direction of motion. The pattern of striations can form a bar code. The image can be a postal indicium printed on a document which is a mail piece, or other documents having value, such as tax stamps and tickets, can be printed.

17 Claims, 6 Drawing Sheets

METHOD AND SYSTEM FOR CREATION OF SECURE DOCUMENTS USING DIGITAL EMBOSSING OF THERMAL MEDIA WITH THERMAL PRINT HEADS

BACKGROUND OF THE INVENTION

The subject invention relates to a method and system for the printing of documents which are difficult to reproduce without detection. More particularly, it relates to printing of documents which have value using a thermal computer printer.

Documents which represent proof of payment (e.g., mail pieces which have been franked with a postal indicium, tax stamps) or which have a monetary value (e.g., tickets) must be secure, i.e., difficult to counterfeit. Printing such documents with a conventional computer printer is difficult, because methods for precise duplication are widely available using off-the-shelf scanning and printing technologies.

One method for solving this problem is to create complex patterns or images on the document, or to embed information in an image or pattern on a document in a manner such that the images or patterns cannot be reproduced with sufficient precision using widely available technologies. These methods, however, require that very high quality printing technology be used to produce the original documents.

Another method is to use a unique stock as the substrate upon which a document is printed. The unique features of the stock help serve to authenticate the original document; the best-known example being the unique stocks used to print currency. Such unique stocks, however, are expensive and require careful management.

While methods such as these have proven useful, their expense become hard to justify when the inherent value or the number of documents is small. For example, postage metering systems, which are well known systems for franking mail pieces as proof of payment of postage, are frequently used by small mailers who mail from a few to a few tens of mail pieces a day, which will not readily support the expense of high quality printing technologies or unique, controlled stock. Thus, it is desirable to use substantially conventional computer printing technologies for postage meters and similar applications. Yet at the same time cumulative postage, particularly for high volume mailers who may mail thousands of mail pieces daily, provides a significant inducement to fraud. Furthermore, while small mailers do not often mail a large number of mail pieces, in certain cases the total postage associated with those mail pieces may be significant enough (e.g., if all the pieces require special handling, e.g. Express Mail®) to induce the small mailer to commit fraud.

FIG. 1 shows a simplified representation of conventional postage meter 10; including a secure accounting system 12, thermal printer controller 14 and thermal print head 16. (Print head 16 is a contact thermal print head where its surface is in sliding contact with the surface of print stock 20 during the printing process; and as used hereinafter the terms "thermal print head" or "thermal printer" refer to such contact printing systems.) Postal information, including a postage amount that will be incorporated into a postal indicium (not shown), is input to accounting system 12. System 12 records the postage amount to assure payment of postage costs. Typically the postage amount is deducted from a pre-paid sum with which meter 10 is "filled", but in other meters the postage amount is simply recorded for later payment. After the postage amount is recorded, the amount, and possibly other information to be incorporated into a postal indicium, are input to printer controller 14, which formats the indicium, typically including fixed graphical elements, the postage amount, and information such as the date, meter serial number, etc. Controller 14 then controls print head 16 to print the indicium on thermal print stock 20.

Print stock 20 (shown in cross-section) includes a polymer top coating 22, thermal ink layer 24 and substrate 28. In operation conventional mechanisms (not shown) move print head 16 and stock 20 so that print head 16 moves through a predetermined raster pattern with respect to stock 20.

FIG. 2 shows a more detailed illustration of the operation of print head 16. Print head 16 (shown partly broken away in FIG. 2) comprises heater elements 16H-1 through 16H-n. Selected ones of heater elements 16H (here elements 16H-1 and 16H-(n−1)) are energized and heated to a threshold temperature for selected time periods by controller 14 as head 16 moves through the predetermined raster pattern to develop regions PE of ink layer 24; thus forming corresponding printed elements of the postal indicium image. Conventionally selected ones of elements 16H are energized by strobing a pulse of predetermined voltage and duration from a power supply output to a selected element, synchronously with the movement of head 16, according to whether or not a corresponding element of a bitmap representative of the indicium is asserted. Note that top coating 22, which is manufactured with a high degree of polish, is substantially unaffected by the normal printing process. Other aspects of postage meter operation, such as security features to prevent tampering with accounting system 12 and the use of encryption technology to uniquely identify postal indicia, are well known to those skilled in the art and need not be discussed further here for an understanding of the subject invention.

Many recently developed postage meter systems are based on conventional microprocessor based computers (e.g., "PCs") and use conventional computer printers to print postal indicia. Thus, controller 14 and print head 16 typically will comprise, or be substantially similar to, an off-the-shelf computer thermal printer. Thus, as discussed above, readily available scanning technology and off-the-shelf printers easily can be used to produce fraudulent duplicate postal indicia, or other documents of value whose production is controlled. While in principle it is possible to detect the use of duplicates of unique documents such as postal indicia, in practice this has proven difficult.

Thus it is an object of the subject invention to provide a method and system for printing secure documents using substantially off-the-shelf computer printing technology.

BRIEF SUMMARY OF THE INVENTION

The above object is achieved and the disadvantages of the prior art are overcome in accordance with the subject invention by a method and system where a contact thermal printing system includes: a) thermal print head having at least one heater element; and b) a thermal printer controller. The printer controller is programmed to: 1) create a predetermined pattern of relative movement between said print head and said thermal print medium while the print head is in contact with a top coating of a thermal print medium; 2) overdrive the heater element during predetermined parts of the pattern to a temperature sufficient to soften or melt the top coating, thereby forming a pattern of striations in the top coating; and 3) control the heater element to print at least part of an image on the medium.

In accordance with one aspect of the subject invention, the contact surface of the print head has a specific pattern of features for forming the striations, whereby a pattern of striations formed can encode information both in the direction of the motion of the print head and transversely to the direction of motion.

In accordance with another aspect of the subject invention the pattern of striations forms a bar code.

In accordance with another aspect of the subject invention the system includes a second print head, and the printed image is printed by the second thermal print head.

In accordance with still another aspect of the subject invention the image is a postal indicium.

In accordance with still another aspect of the subject invention, the system further includes an accounting system for accounting for postage represented by the postal indicium.

In accordance with still yet another aspect of the subject invention, the printer controller operates in a second mode to print the image without forming the striations.

Other objects and advantages of the subject invention will be apparent to those skilled in the art from consideration of the detailed description set forth below and the attached drawings.

DETAILED DESCRIPTION OF PREFERRED EMBODIMENTS OF THE INVENTION

Figure 1:
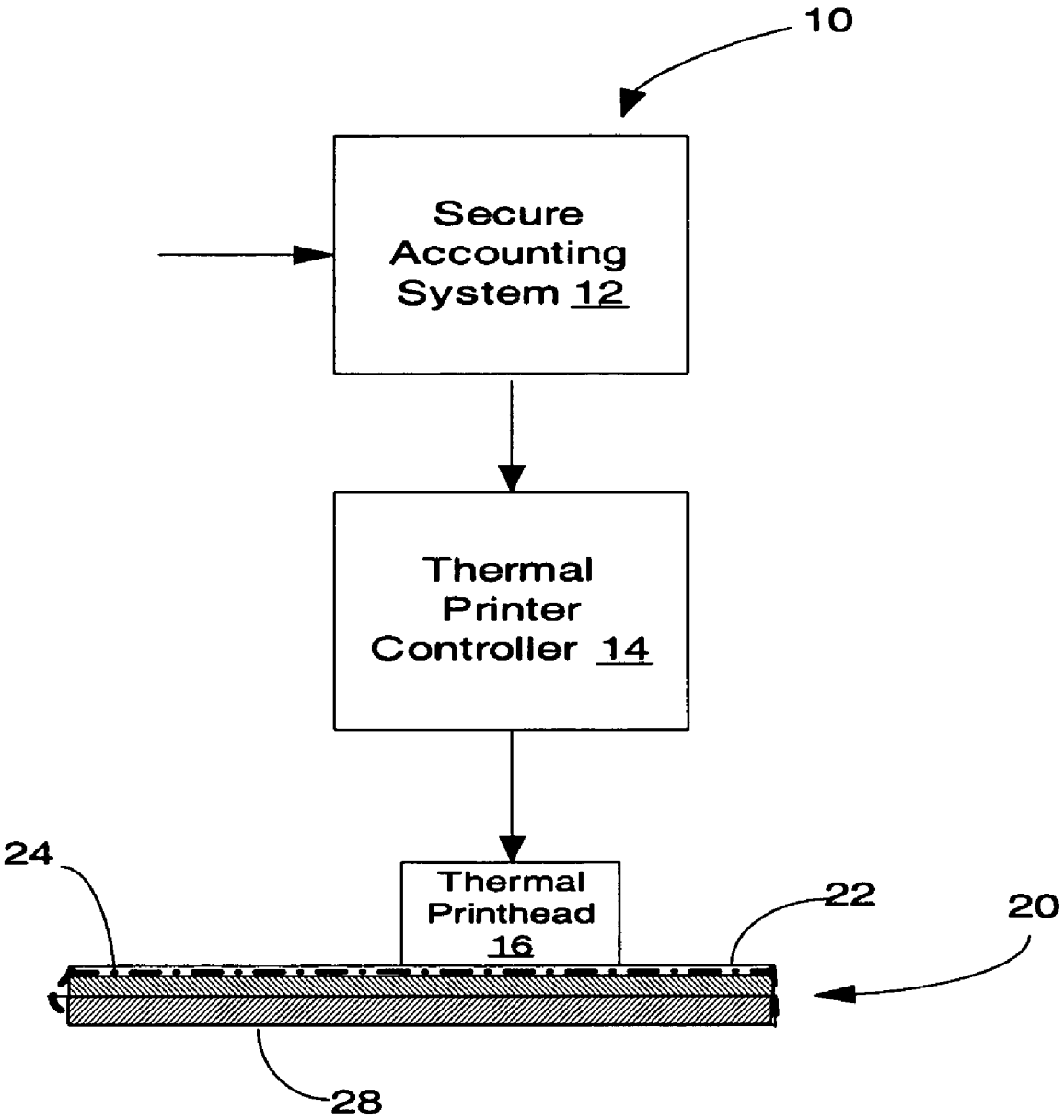
FIG. 1 (prior art)
FIG. 1 shows a schematic block diagram of a conventional contact thermal printer.
Figure 2:
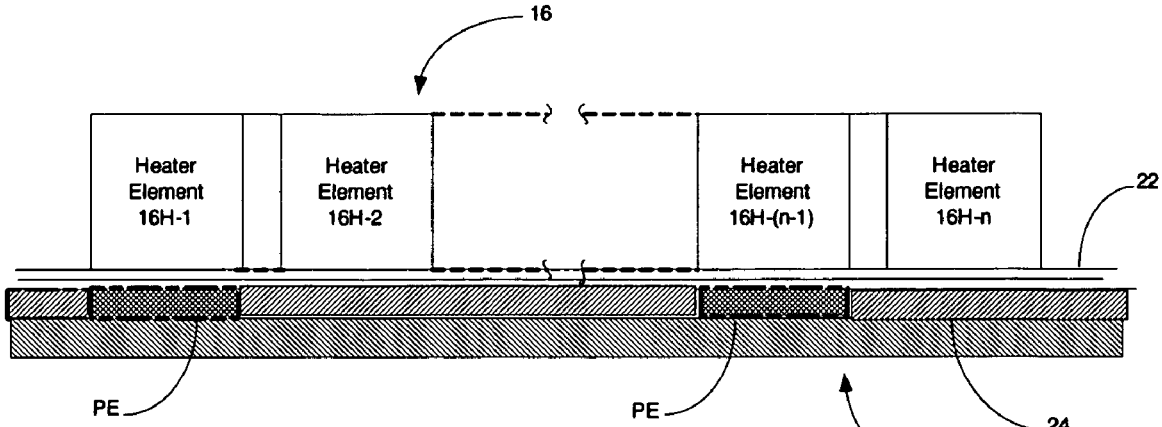
FIG. 2 (prior art)
FIG. 2 shows a more detailed, schematic illustration of the operation of the printer of FIG. 1.
Figure 3:
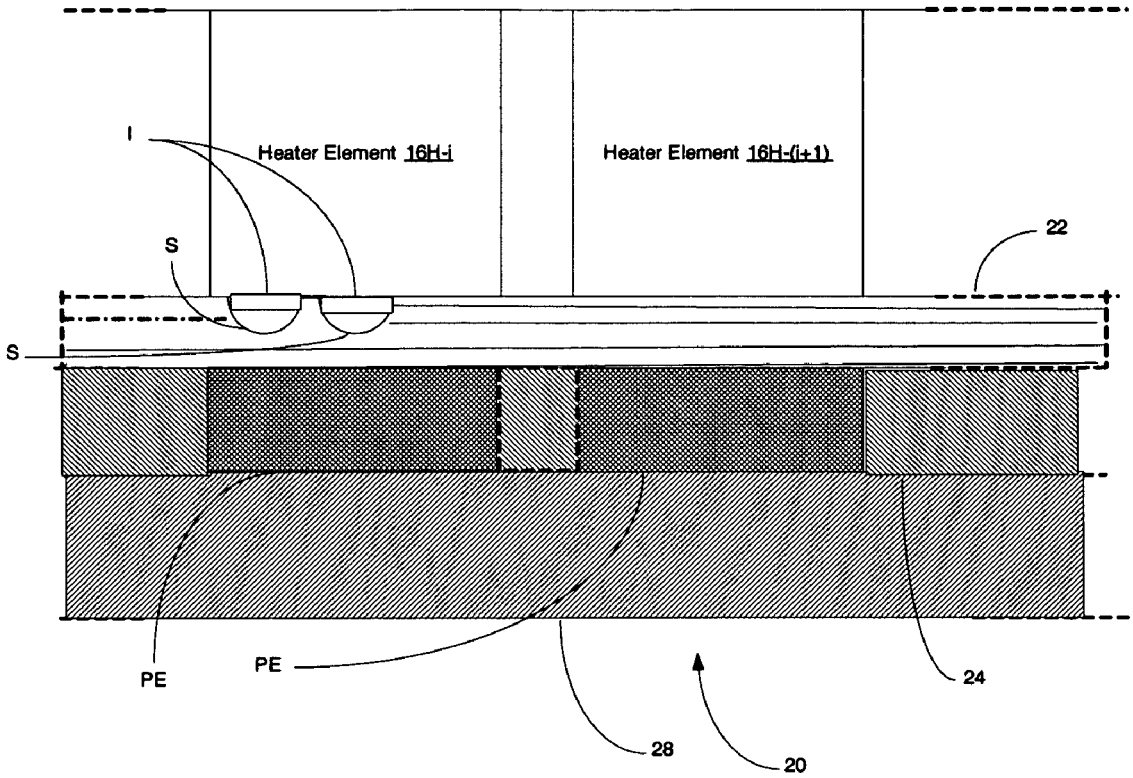
FIG. 3 shows a more detailed, schematic illustration of the operation of a contact thermal printer when a heater element is overdriven.

FIG. 3 illustrates a contact thermal printing process modified in accordance with the subject invention. When selected heater elements (here elements 16H-i and 16H-(i+1)) are overdriven to a temperature greater than the threshold for fully saturated development of ink layer 24 in regions PE and sufficient to soften or melt top coating 22, small imperfections I in the contact surface emboss striations S into top coating 22. It has been found that these striations S are visually observable. Note that since the imperfections are substantially random in location and size on print head 16, the resulting striations S are also random, and it is possible that some heater elements (here element 16H-(i+1)) may produce no, or very slight, striations even though overdriven.

Figure 4:
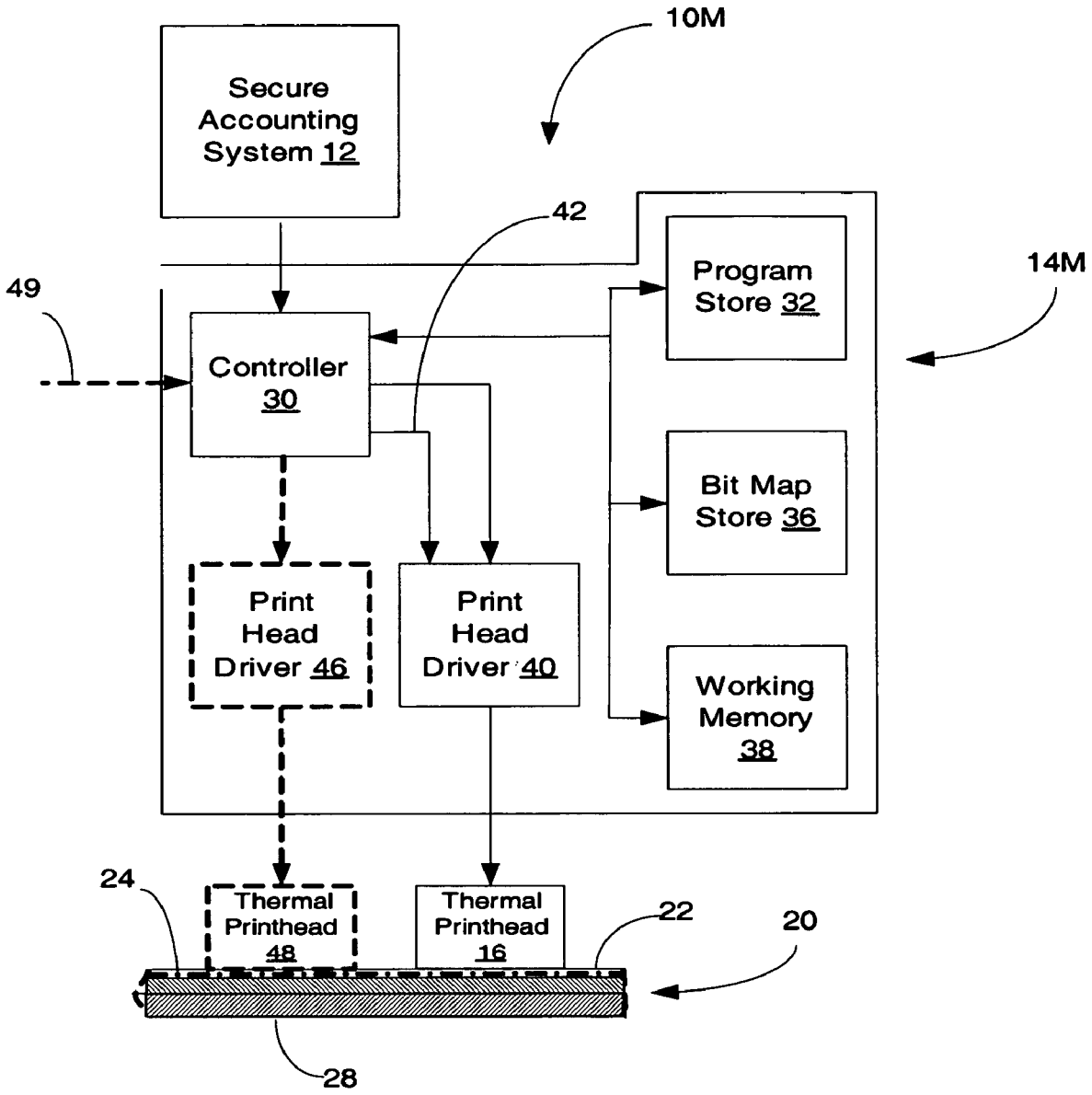
FIG. 4 shows a schematic block diagram of a contact thermal printer in accordance with the subject invention.

In FIG. 4 postage meter includes accounting system 12, which operates in an essentially conventional manner to account for postage expended and output data to determine an image to be printed, thermal printer controller 14M and print head 16. Thermal printer controller includes: controller 30; program store 32, which stores the control program for printer controller 14M; bit map store 34 which stores bit map representations of graphical elements of the postal indicia; working memory 38; and print head driver 40, responsive to controller 30 to energize print head 16.

In a preferred embodiment of the subject invention, printer controller 14M includes input 42 from controller 30 to driver 40. When activated, input 42 controls driver 40 to overdrive selected ones of print head elements 16H and cause striations S to be embossed into layer 22.

Typical temperatures to develop regions PE in ink layer 24 are 110 C to 120 C and vary with the selected media. The temperature for embossing striations S range from 180 C to 250 C, varying with the selected media, to a high end limited only by the threshold of breakdown of the thermal print head circuit material. Preferred methods of overdriving print head elements 16H are:

a) Change the supply voltage to the print head (this will cause all elements that are printing to melt layer 22 and emboss striations S).

b) Lengthen the strobe width (again causing all elements that are on to melt layer 22 and emboss striations S).

c) Generate multiple strobes for each column of data that is printed. (The first strobe would print the image. A second strobe, possibly of longer duration, would energize the selected one of elements 16H enough to overheat layer 22 and emboss striations S).

In another embodiment of the subject invention, second controller 46 controlling second print head 48 is provided in place of input 42, and is designed to operate at a temperature which will emboss striations S.

Figure 5:
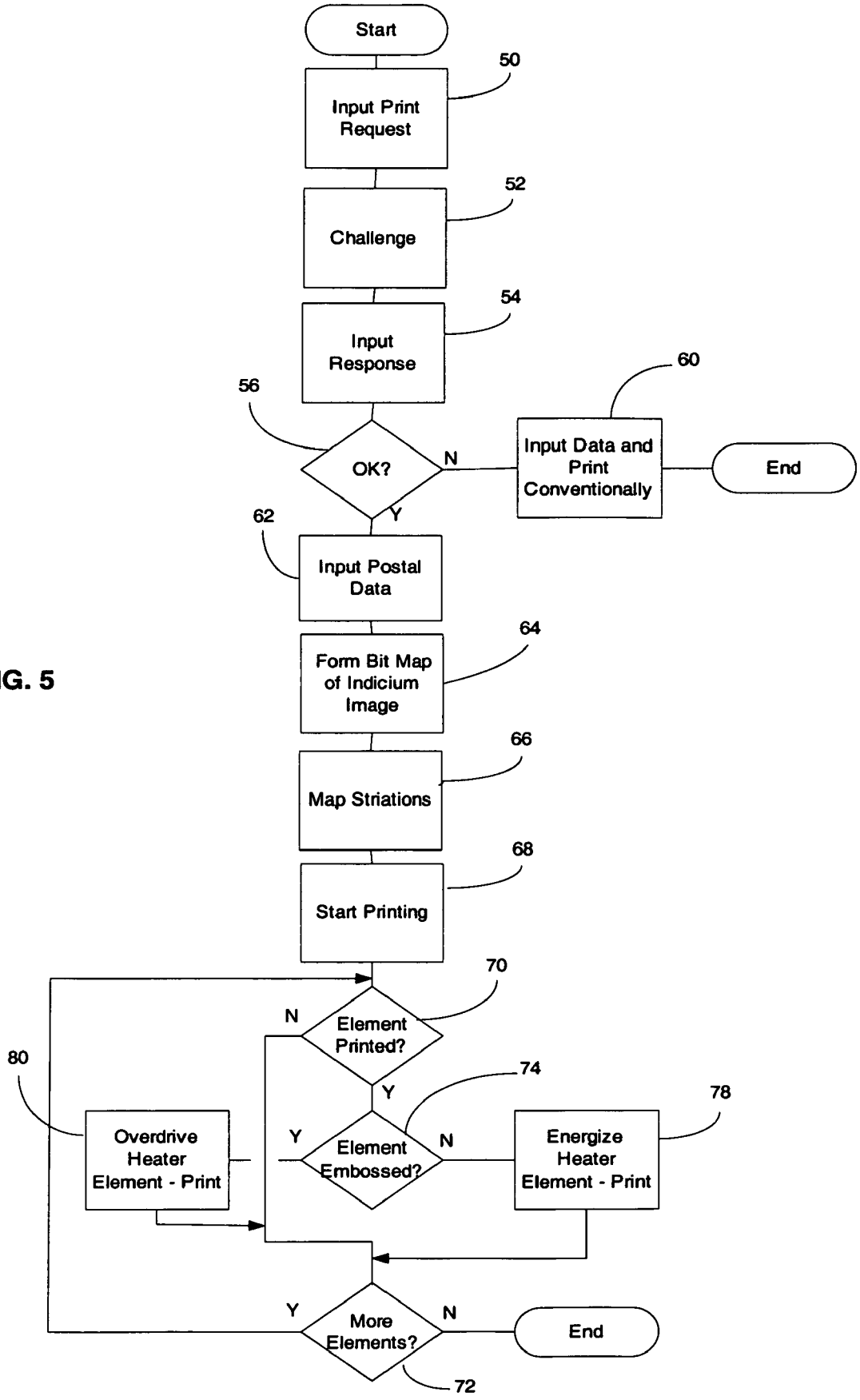
FIG. 5 shows a schematic block diagram of a contact thermal printer in accordance with the subject invention.

FIG. 5 shows a flow diagram of the operation of printer controller 14M. At step 50, controller 30 inputs a print request from accounting system 12. At steps 52 and 54, encrypted challenges and responses are exchanged between system 12 and controller 30 to provide assurance that the request to print a postal indicium is a valid request and that appropriate accounting has been made for the postage amount represented by the requested indicium. Such challenge and response protocols provide assurance that proper accounting has been made for a postal indicium and are well known in the art and need not be described further here for an understanding of the subject invention.

In other embodiments of the subject invention, assurance of appropriate accounting can be provided by means such as: encryption of data; enclosure of meter 10M in a secure, tamper-proof housing; or the use of connectors which are uniquely, mechanically keyed to provide signal paths between accounting system 12 and controller 14M.

At step 56, controller 30 determines if the appropriate response has been received. If not, or if in another embodiment of the subject invention data is received through auxiliary input 49, at step 60 controller 30 inputs and prints data in a conventional manner; thus allowing controller 14M and print head 16 to function in a second mode as a conventional computer printer for purposes such as printing of addresses on mail pieces. Otherwise, if the challenge/response protocol is satisfied, at step 62 controller 30 inputs postal data, including a postage amount which determines variable portions of a postal indicium to be printed. Then at step 64, controller 30 assembles bit map representations of various graphical elements of indicia, e.g., logos and alphanumeric characters, stored in bit map store 36 to form a bit map of the indicium to be printed and stores this in working memory 38. Then at step 66, controller 30 maps the elements of the printed image which are to be embossed with striations S. In embodiments of the subject invention where striations S are embossed using second print head 48, this mapping is offset to compensate for the offset of print head 48 from print head 16.

Because elements are substantially overheated to emboss striations, it is believed that the area printed beneath such striations will "bloom", i.e., expand to overlap areas beneath other elements. Therefore, striations S are preferably embossed over a fully printed (i.e., solid black) portion of the indicium. Typically this area will be incorporated into the indicium specifically for embossing striations S, but can be a portion of the indicium which is normally printed in any case.

In one embodiment of the subject invention, striations S form any convenient pattern which can then be detected by visual inspection to provide an indication that the indicium is an original document and not a duplicate. In other preferred embodiments, striations S encode forensic information such as a meter serial number, postage amount, etc., preferably in the form of a bar code read in the print direction, which can be used to further assure the authenticity of the indicium.

Then at step 68, controller 30 starts to print the indicium. At step 70, it determines from the bit map generated at step 64 if the next image element is to be printed. If not, at step 72 it determines if there are more image elements, and, if there are, returns to step 70. If the current image element is to be printed, then at step 74, controller 30 determines if it is to be embossed with striations S.

If the element is not to be embossed, then at step 78, heater element 16H is energized, and the current image element is printed. Otherwise, at step 80 heater element 16H is overdriven, and the current image element is embossed and printed. In either case controller 30 then goes to step 72 to determine if there are more elements, and, if not, exits.

Other functions of thermal printer controller, which are well known to those skilled in the art, have not been described in detail here to simplify the description. Printer controller 14M synchronizes printing with the movements of stock 20 and print head 16 (and 48, if used) by conventional transport mechanisms (not shown) to generate the printed image. Also controller 14 M has been described as operating on one image element at a time, i.e., as if print head 16 had only a single heater element. In the more typical case, as shown above, where print head 16 has multiple heater elements, controller 30 will operate in a conventional manner to make the determination for each image element corresponding to each heater element and then control each of heater elements 16H-1 through 16H-n to print the image elements concurrently.

In the above described embodiment embossed striations S are formed on the same scale as the image elements and correspond to printed image elements. This is preferred since embossing striations S causes the underlying portion of ink layer 24 to be developed. However, in other embodiments, where striations S are embossed in a portion of the indicium separate from the printed image, striations S can be formed to any convenient scale.

Figure 6:
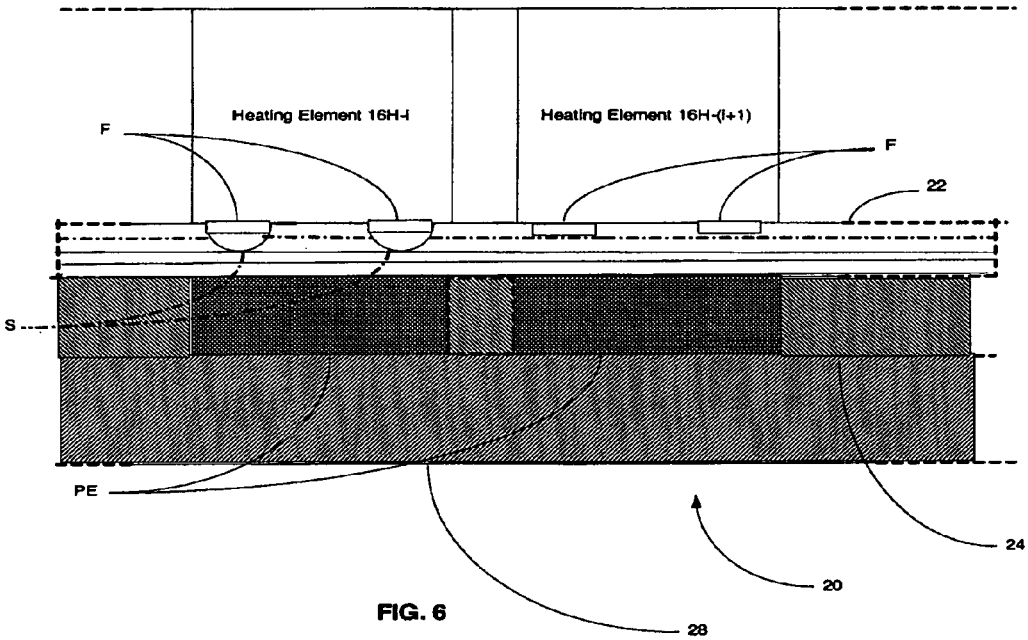
FIG. 6 shows a more detailed, schematic illustration of the operation of a contact thermal printer in accordance with another embodiment of the subject invention, when a heater element is overdriven.

FIG. 6 illustrates a contact thermal printing process in accordance with another embodiment of the subject invention. In FIG. 6, print head 16 is manufactured in any convenient manner, such as machining, or polishing and etching, so that randomly distributed imperfections I are removed and replaced by a pattern of uniformly distributed features F. The random distribution of imperfections I prevents coding of information transversely to the print direction. In FIG. 6 features F are distributed in a uniform pattern so that each of heater elements 16H corresponds to the same configuration of features F. Thus, by selectively not overdriving heater elements (here element 16H-(i+1) a two dimensional pattern of striations S in top coating 22, preferably a two dimensional bar code pattern, coding information in each direction, can be generated.

It should be noted that contact thermal printing is well known, and it is believe to be likely that striations, as described above, may have been observed as a result of accidental malfunctions of such printers; however it is not believed that such striations, if in fact observed, were ever considered as anything other than defects or imperfections.

The embodiments described above and illustrated in the attached drawings have been given by way of example and illustration only. From the teachings of the present application, those skilled in the art will readily recognize numerous other embodiments in accordance with the subject invention. Particularly, it will be apparent to those skilled in the art that the method and system of the present invention can be applied of printing of other controlled documents of value such as tax stamps and tickets. Accordingly, limitations on the subject invention are to be found only in the claims set forth below.

What is claimed is:

1. A method for thermal printing of documents that are inherently difficult to counterfeit, comprising the steps of:

a) placing a thermal print head having at least one heater element in contact with a sheet of thermal print medium, said thermal print medium having a top coating in contact with said print head and creating a predetermined pattern of relative movement between said print head and said thermal print medium;

b) overdriving said heater element during predetermined parts of said pattern to a temperature sufficient to soften or melt said top coating, thereby forming a pattern of striations in said top coating; and c) printing an image on said medium.

2. A method as described in claim 1 comprising the further step of forming the contact surface of said print head to have a specific pattern of features for forming said striations, whereby a pattern of striations formed can encode information both in the direction of said motion of said print head and transversely to said direction of motion.

3. A method as described in claim 2 where said pattern of striations forms a two-dimensional bar code.

4. A method as described in claim 2 where said printed image is printed by a second thermal print head.

5. A method as described in claim 1 where said image is printed by a second thermal print head.

6. A method as described in claim 1 where said pattern of striations forms a bar code.

7. A method as described in claim 1 where said predetermined image is a postal indicium.

8. A contact thermal printing system, comprising:

a) thermal print head having at least one heater element; and b) a thermal printer controller for:

b1) creating a predetermined pattern of relative movement between said print head and a thermal print medium while said print head is in contact with a top coating of said thermal print medium;

b2) overdriving said heater element during predetermined parts of said pattern to a temperature sufficient to soften or melt said top coating, thereby forming a pattern of striations in said top coating;

b3) controlling said heater element to print at least part of an image on said medium.

9. A system as described in claim 8 where the contact surface of said print head has a specific pattern of features for forming said striations, whereby a pattern of striations formed can encode information both in the direction of said motion of said print head and transversely to said direction of motion.

10. A system as described in claim 9 where said pattern of striations forms a two-dimensional bar code.

11. A system as described in claim 9 further comprising a second print head, and said printed image is printed by a second thermal print head.

12. A system as described in claim 8 further comprising a second print head, and said printed image is printed by said second thermal print head.

13. A system as described in claim 8 where said pattern of striations forms a bar code.

14. A system as described in claim 8 where said image is a postal indicium.

15. A system as described in claim 14 further comprising an accounting system for accounting for postage represented by said postal indicium.

16. A system as described in claim 15 where said printer controller includes means for assuring that a proper accounting has been made for said postage.

17. A system as described in claim 8 where said printer controller operates in a second mode to print said image without forming said striations.

* * * * *